US006059650A

United States Patent [19]

Stoltz et al.

[11] Patent Number: 6,059,650

[45] Date of Patent: May 9, 2000

[54] SYSTEM AND METHOD FOR COIN SINGULATION

[75] Inventors: Gregory E. Stoltz, Dallas; Algert J. Maldanis, Heath, both of Tex.

[73] Assignee: Agent Systems, Inc., Dallas, Tex.

[21] Appl. No.: 09/060,033

[22] Filed: Apr. 13, 1998

[51] Int. Cl.[7] ..... G07D 1/00

[52] U.S. Cl. ..... 453/40; 453/49; 453/57; 198/803.16

[58] Field of Search ..... 453/57, 49, 32, 453/40; 198/803.16

[56] References Cited

U.S. PATENT DOCUMENTS

| | | | |
|---|---|---|---|
| 3,603,327 | 9/1971 | Buchholz et al. | 453/57 |
| 4,210,801 | 7/1980 | Gomez et al. | 235/92 |
| 4,310,749 | 1/1982 | Gomez et al. | 235/29 |
| 4,372,478 | 2/1983 | Gomez et al. | 232/12 |
| 4,376,442 | 3/1983 | Gomez et al. | 133/3 |
| 4,380,316 | 4/1983 | Glinka et al. | 232/16 |
| 4,407,312 | 10/1983 | Davila et al. | 133/8 |
| 4,453,667 | 6/1984 | Zerfahs | 232/7 |
| 4,471,905 | 9/1984 | Sloma et al. | 232/12 |
| 4,474,281 | 10/1984 | Roberts et al. | 194/1 |
| 4,730,117 | 3/1988 | Zack | 250/568 |
| 4,795,087 | 1/1989 | Procak | 232/7 |
| 4,877,179 | 10/1989 | Baker et al. | 232/7 |
| 4,977,502 | 12/1990 | Baker et al. | 364/405 |
| 5,225,665 | 7/1993 | Zerfahs et al. | 235/384 |
| 5,295,900 | 3/1994 | Tsuchida et al. | 453/57 |
| 5,355,988 | 10/1994 | Shirasawa | 453/32 |
| 5,574,441 | 11/1996 | Roes et al. | 340/870 |

*Primary Examiner*—Robert P. Olszewski
*Assistant Examiner*—Bryan Jaketic
*Attorney, Agent, or Firm*—Fulbright & Jaworski L.L.P.

[57] ABSTRACT

A system and method are taught for receiving a plurality of different sized coins substantially simultaneously and outputting the received coins serially. The output of coins according to the preferred embodiment of the disclosed invention is controlled so as not to exceed a predetermined rate in order to accommodate systems downstream, such as a coin validator. The disclosed coin singulator system is substantially free of obstructions likely to cause jamming or miss-feeding of coins as well as to provide open access to an operator to remove coins prior to their singulation.

49 Claims, 3 Drawing Sheets

SYSTEM AND METHOD FOR COIN SINGULATION

TECHNICAL FIELD OF THE INVENTION

The present invention relates in general to separating or singulating individual coins from a plurality of coins, and more particularly to an automated system and method for accepting a plurality of mixed denomination coins and outputting them serially for further action such as validation and counting.

BACKGROUND OF THE INVENTION

It is common today to provide for the automated acceptance of currency in transactions. For example, transit busses in the United States and Canada are normally equipped with fareboxes to collect fares from riders and securely store the coins, tokens, and bills used to pay these fares.

Typically, so as to allow more rapid boarding of the bus by fare paying patrons, the fareboxes are adapted to receive the coinage of the passenger's fare in bulk, i.e., the passenger drops a hand full of coins into a chute in payment of the fare. This hand full of coins may include many denominations of coins possibly ranging from pennies through Susan B. Anthony dollars. In some prior art systems, this hand full of coins would simply pass to an escrow area, visible to the bus operator, in order to allow the operator to determine if the proper fare has been tendered.

However, in more sophisticated systems, automatic accounting for the fare may be provided. Accordingly, the fare may be singulated for serial output to a coin rejector through the use of a coin singulator. However, in typical prior art systems the coin singulator utilizes a plurality of pins, brushes, gates, and/or slots in order to provide singulation. Although such systems will operate to singulate coins, they suffer from the disadvantage of presenting a plurality of surfaces between which coins may become jammed or retained.

Furthermore, these prior art systems, due to their slots and gates do not provide ready access for an operator to clear such jams. Instead, typically a mechanical arm arrangement with brushes is operated in an effort to clear jams or miss-feeds. However, if this mechanical clearing mechanism should fail, such prior art singulators must be disassembled by a technician in order to once again be put into operation. This can require a very expensive resource, such as a city bus, to be removed from service for a somewhat minor problem.

Accordingly, a need exists in the art for a coin singulator adapted to provide serial output of a plurality of coins received substantially simultaneously, including various denominations of coins, which presents a minimum of surfaces and voids for causing jamming, retention, or miss-feeds of the coins.

A further need exists in the art for a coin singulator which is open in design to allow for an operator to remove coins, and other objects, prior to their singulation. Accordingly, an operator may easily self service jams without necessitating return of the system to a service facility.

SUMMARY OF THE INVENTION

These and other objects, features and technical advantages are achieved by a system and method which provides an open area to accept a plurality of different denomination, i.e., differing sized, coins substantially simultaneously, and operates to singulate the coins for output at a predetermined maximum rate, irrespective of the denominational make-up of the plurality of coins, for subsequent coin handling operations such as verifying, counting, or storing. In order to avoid jamming of the coins during the singulation operation, the preferred embodiment of the present invention utilizes substantially smooth surfaces, i.e., no pins, brushes, gates, or slots are used. Accordingly, the singulator presents very few, if any, surfaces between which the coins to be singulated may jam or other wise become trapped. Additionally, the preferred embodiment of the present invention utilizes a minimum of operational parts to further reduce the available surfaces between which coins may jam or other wise become trapped, as well as for efficiency from a cost and maintenance point of view.

A preferred embodiment of the present invention includes an open receiving area for reception of the plurality of coins to be singulated. This open area provides both unrestricted, and therefore rapid, acceptance of coins into the singulator as well as unrestricted access for an operator to remove coins, or other objects, prior to singulation. As it is anticipated that the coin singulator of the present invention will be used in demanding environments, such as in public busses for fare acceptance and validation, as in the farebox shown and described in the above referenced application entitled "Automatic Validating Farebox System And Method," it is expected that the coin singulator will be exposed to conditions requiring operator intervention. For example, badly damaged coins or foreign objects, such as stones, washers, marbles, and lint, may find their way into the coin singulator along with coins tendered. These objects may remain in the coin acceptance area of the coin singulator, where they at best reduce the available space for acceptance of coins and at worst obstruct the flow of coins to be singulated. Furthermore, these objects may cause jamming of the singulator. Accordingly, the open coin receiving area of the preferred embodiment of the present invention allows an operator to easily remove such objects.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DESCRIPTION OF THE PREFERRED EMBODIMENTS

Figure 1:
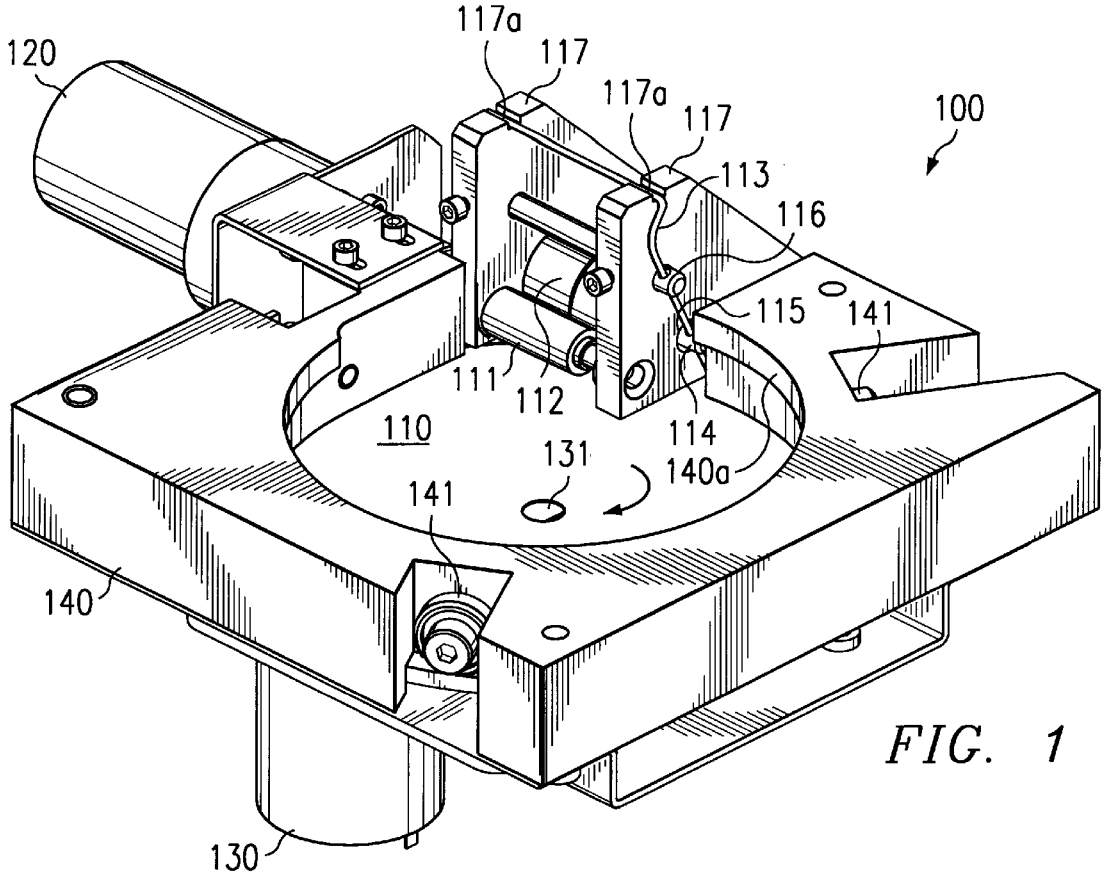
FIG. 1 shows a preferred embodiment of a coin singulator according to the present invention in an isometric view from the back left.

Directing attention to FIG. 1, a preferred embodiment of a coin singulator according to the present invention is shown in an isometric view from the back left. Coin singulator 100 is shown having frame 140 and rotating disk 110 defining a coin receiving area. It shall be appreciated that the coin receiving area defined by frame 140 and rotating disk 110 is generally open, relatively large with respect to individual coins, and free of obstructions which may jam or trap received coins.

In a preferred embodiment frame 140 is adapted to expose an area of rotating disk 110 having a radius of approximately 2.04 inches. This size of coin receiving area has been determined to present adequate volume to accept a plurality of coins as well as sufficient surface area of rotating disk 110 to allow for the proper movement of the coins for presentation to the singulation mechanism of the present invention.

In the preferred embodiment, frame 140 includes ledge 140*a* disposed to protrude into the coin receiving area defined by frame 140 and rotating disk 110. Preferably, ledge 140*a* is positioned to prevent coins accepted in the coin receiving area from standing on edge and, thus, avoid properly engaging the coin singulating mechanism. Accordingly, a bottom surface of ledge 140*a* is disposed a distance from rotating disk 110 less than the diameter of the smallest acceptable coin. Ledge 140*a* may be tapered, or otherwise shaped, so as to present a surface adapted to prevent the wedging or trapping of coins or other objects, such as between the bottom surface of ledge 140*a* and a top surface of rotating disk 110.

Preferably, frame 140 includes bearings, such as roller bearings 141, to rotatably engage rotating disk 110. Accordingly, rotating disk 110 may be disposed very close to frame 140, thus engaging roller bearings 141, so as to present as little gap there between as possible. By presenting a very small gap between frame 140 and rotating disk 110 the possibility of a coin or other object becoming wedged between surfaces of these two components of coin singulator 100 is reduced. However, as it is possible that objects small enough to infiltrate any gap between frame 140 and rotating disk 110 may be introduced into the coin receiving area of coin singulator 100, the preferred embodiment of rotating disk 110 is movably mounted with respect to frame 140 as will be described in detail with respect to FIG. 5 hereinbelow.

In an alternative embodiment, in order to dissuade coins from remaining at the center of rotating disk 110, i.e., where centrifugal forces may not be great enough to encourage movement toward frame 140, shaft 131 may be extended to protrude beyond the surface of rotating disk 110. The top of extended shaft 131 may be domed or other wise sloped to prevent coins from remaining thereon in lieu of falling to rotating disk 110. Of course other methods of preventing coins from remaining in the center of rotating disk 110 may be utilized, if desired. For example, other appendages, such as a domed housing, may be affixed at the center of rotating disk 110. Likewise, rotating disk 110 may itself be sloped from the center toward frame 140, i.e., a conic rotating surface. Of course, the conic embodiment of rotating disk would require corresponding adjustment of the coin singulation mechanism discussed hereinbelow.

In the embodiment of FIG. 1, rotating disk 110 rotates in a clockwise motion, when energized, to encourage coins received into the coin receiving area, defined by rotating disk 110 and frame 140, toward a singulation mechanism located at the front of coin singulator 100. The coins are encouraged toward the singulation mechanism both through the surface friction between rotating disk 110 and the coins in contact therewith as well as the centrifugal force created by the rotating motion. Accordingly, received coins, regardless of where they are initially received in the coin receiving area defined by frame 140 and rotating disk 110, are ultimately encouraged to position themselves for engaging the singulation mechanism of the present invention.

In a preferred embodiment of the present invention, the surface of rotating disk 110 is machined aluminum. Machined aluminum has been found through experimentation to present a sufficient coefficient of friction to encourage received coins to move in the direction of rotating disk 110. Likewise, machined aluminum has also been found to allow sufficient slippage of the received coins to allow centrifugal forces to encourage the received coins radially outward across the surface of the rotating disk toward frame 140 for proper engaging with the singulation mechanism of the present invention.

The coin singulation mechanism of the preferred embodiment of coin singulator 100 includes stripper roller 111 and feed roller 112. Stripper roller 111 is disposed to engage received coins presented by rotating disk 110 first. The direction of rotation of stripper roller 111 is selected such that the surface of stripper roller 111 closest to rotating disk 110 moves in substantially the opposite direction of rotating disk 110, i.e., striper roller 111 presents an opposing force to any object presented by rotating disk 110 which engages stripper roller 111. By disposing stripper roller 111, as through mounting on brackets 117, such that its axis of rotation is substantially parallel to the surface of rotating disk 110, and the closest surface of stripper roller 111 at least slightly greater than the thickness of the thickest acceptable coin and at least slightly less than twice the thickness of the thinnest acceptable coin, stripper roller 111 operates to allow only a single layer of coins to pass to feed roller 112.

Moreover, placement of stripper roller 112 may be selected to provide singulation of objects other than allowable coins expected to be received by coin singulator 100. For example, where foreign currency or tokens are expected to intermingle with acceptable currency, not only might the thickness of the thickest acceptable coin and twice the thickness of the thinnest acceptable coin be utilized in determining placement of stripper roller 112, but so too may consideration of the attributes of the other expected objects. Accordingly, the present invention may operate to handle such objects without operator intervention. The interaction of stripper roller 111 and rotating disk 110 will be described in further detail below with respect to FIG. 4.

It shall be appreciated that in addition to presenting coins in multiple layers, i.e., stacked, rotating disk 110 may also present coins two abreast. For example, although the centrifugal force created by rotation of rotating disk 110 will encourage the received coins outward toward frame 140, one coin may restrict another coin's movement toward frame 140. Accordingly, the singulation mechanism of the present invention is adapted to allow only a single coin to pass to feed roller 112, i.e., only a single layer of a single coin abreast. In the preferred embodiment illustrated in FIG. 1, the area between rotating disk 110, stripper roller 111, and brackets 117, through which all coins to be output by singulator 100 must pass, is of a width selected so as to be great enough to allow the largest diameter acceptable coin to pass while being small enough to prevent two of the smallest diameter acceptable coins to pass abreast. For example, when using United States currency, the largest diameter acceptable coin may be a Kennedy half dollar, whereas the smallest diameter acceptable coin may be a dime. Accordingly, the spacing between brackets 117, and therefore the coin engaging length of stripper roller 111, may be within the range of sizes from slightly larger than the diameter of the Kennedy half dollar to slightly smaller than twice the diameter of a dime. Of course, in situations where this is impossible, certain "double" coins will pass through the mechanism.

Feed roller 112 is disposed in the coin feed path of coin singulator 100 after stripper roller 111. Accordingly, feed roller 112 engages coins one at the time as stripper roller 111 allows them to pass from the coin receiving area of coin singulator 100.

Feed roller 112 operates to engage coins as presented by rotating disk 110 and eject the coins for output from coin singulator 100. Accordingly, the direction of rotation of feed roller 112 is selected such that the surface of feed roller 112 closest to rotating disk 110 moves in substantially the same direction as rotating disk 110, i.e., feed roller 112 presents a complementary force to any object presented by rotating disk 110 which engages feed roller 112. By disposing feed roller 112, as through mounting on brackets 117, such that its axis of rotation is substantially parallel to the surface of rotating disk 110, and the closest surface of feed roller 112 is encouraged to be at least slightly less than the thickness of the thinnest acceptable coin, feed roller 112 operates to engage all coins presented by rotating disk 110. The interaction of feed roller 112 and rotating disk 110 will be described in further detail below with respect to FIG. 4.

It shall be appreciated that, as described above, the rotation of stripper roller 111 and feed roller 112 are in opposite directions. Accordingly, in a preferred embodiment of the present invention, the surfaces of stripper roller 111 and feed roller 112 engage so as to transfer rotation energy there between. As such only one of stripper roller 111 and feed roller 112 need be powered and the other one of the rollers may derive its power there from.

In order to engage a plurality of different denomination coins, i.e., coins having different thicknesses, feed roller is preferably movably mounted in coin singulator 100. In the preferred embodiment of FIG. 1, brackets 117 include oversized bore 115. Oversized bore 115 allows shaft 114 of feed roller 112 to travel in order to accommodate differing thicknesses of coins. Accordingly, oversized bore 115 is disposed in frames 117 such that shaft 114 may travel downward a sufficient distance to allow the surface of feed roller 112 closest to rotating disk 110 to engage the thinnest acceptable coin while also allowing shaft 114 to travel upward a sufficient distance to allow feed roller 112 to also pass the thickest acceptable coin.

Moreover, oversized bore 115 may be sufficiently sized to allow feed roller to engage expected objects other than the allowable coins. For example, where foreign currency is expected to intermingle with acceptable currency, oversized bore 115 may be selected so as to allow feed roller 112 to engage this expected foreign currency and expel it from the coin singulator for subsequent processing, such as rejection by a coin validator later in the coin feed path. Of course, rather than the oversized bore shown, the present invention may utilize a slot, arc, or other movable retaining means for allowing feed roller 112 to accommodate various coins.

In order to encourage feed roller 112 to remain a closest distance from rotating disk 110, so as to engage all coins including the thinnest acceptable coin, the preferred embodiment of the present invention includes spring 113. Spring 113, coupled to bracket 117 at pivot point 116 and located in grove 117A, the location of which with respect to pivot 116 and oversized bore 115 applies a preload to spring 113 and thus provides a bias force to feed roller 112 through shaft 114 toward rotating disk 110. This force causes feed roller 112 to remain a closest possible distance to rotating disk 110 and, thus, to engage all coins passing there between.

It shall be appreciated that spring 113 also provides a bias force to feed roller 112 toward stripper roller 111. Accordingly, in the preferred embodiment, the surfaces of stripper roller 111 and feed roller 112 are encouraged to remain engaged for the transfer of rotation power there between even as feed roller travels upward and downward to engage different sized coins.

Still referencing FIG. 1, motors 120 and 130 are shown. Preferably motor 120 provides rotational energy to the singulation mechanism of singulator 100. In the preferred embodiment the energy of motor 120 is provided to stripper roller 111 with rotational energy being provided to feed roller 112 by surface communication of these two rollers, thus, allowing for the movement of feed roller 112 to accommodate various coin thicknesses while still providing rotational energy. Energy from motor 120 may be transferred to the stripper mechanism directly, i.e., the shaft of motor 120 may be coupled directly to stripper roller 111, or indirectly, i.e., a series of gears or fly wheels, possibly including speed reduction or augmentation gearing, may be utilized to transfer the energy.

The speed of rotation of feed roller 112 is important so as not to eject coins fed thereby at too great of speed, i.e., both to avoid too rapid of coin ejection for subsequent handling down stream as well as to avoid too energetic of coin ejection causing undesirable coin travel such as undesired bouncing and deflection off of coin chutes down stream. Likewise, the speed of rotation of stripper roller 111 is important so as to provide sufficient energy to "kick" stripped coins away from the coins being allowed to pass. Accordingly, the speed of rotation, i.e., revolutions per minute (RPM), of motor 120 is selected to provide rotation of feed roller 112 such that coins are ejected at a predetermined maximum rate and such that stripper roller 111 rotates sufficiently fast to cause stripped coins to be kicked back into the coin receiving area of coin singulator 100. The interaction of stripper roller 111 and feed roller 112 will be discussed in greater detail with respect to FIG. 4 hereinbelow.

Motor 130 provides rotational energy to rotating disk 110. Energy from motor 130 may be transferred to rotating disk 110 directly, i.e., the shaft of motor 130 may be coupled directly to rotating disk 110, or indirectly, i.e., a series of gears or fly wheels, possibly including speed reduction or augmentation gearing, may be utilized to transfer the energy. The transfer of energy will be discussed further with respect to FIG. 5 hereinbelow.

The speed at which coins are presented to the singulation mechanism of singulator 100 is important in providing a desired maximum output for subsequent handling of the coins downstream. Likewise, the rotational speed of rotating disk 110 is important in providing sufficient centrifugal forces to encourage the received coins to move toward frame 140 for singulation by the singulation mechanism of singulator 100. Accordingly, the speed at which motor 130 operates, i.e., the RPM of motor 130, is preferably chosen taking the above into consideration. In the preferred embodiment of the present invention, the speed of motor 130 is selected to result in the rotation of rotating disk 110 at approximately 200 RPM.

It shall be appreciated, although separate motors are shown providing energy to the singulation mechanism and the rotating disk of the present invention, that there is no such limitation on the present invention. For example, a single motor may be utilized to provide energy, such as through a gearing arrangement, to both the rotating disk and the singulation mechanism. However, a preferred embodiment of the present invention utilizes two motors as shown in FIG. 1 to, inter alia, allow for the rotation of the rotating disk to be reversed without reversing the rotation of the singulation mechanism in order to assist in clearing jams and miss-feeds. Of course, the aforementioned gearing may be adapted so as to provide this feature with a single motor, if desired.

Preferably coin singulator 100 includes a sensor (not shown) to detect the presence of received coins and therefore to start operation of motors 120 and 130 for coin singulation according to the present invention. This sensor may be an opto-electronic device or switch which is engaged when coins are received into the receiving area of coin singulator 100. For example, an opto-electronic sensor may be deployed on the sides of frame 140 to detect the presence of coins on rotating disk 110. Likewise, a switch may be placed in communication with rotating disk 110 to detect the presence of coins thereon, such as through deflection due to a change in weight supported by rotating disk 110. Alternatively, the sensor may be deployed in the feed path through which the received coins are feed into the receiving area, such as at a coin acceptance chute of the farebox shown and described in the above referenced application entitled "Automatic Validating Farebox System And Method." Accordingly, detection of coins by the sensor may result in timed operation of motors 120 and 130 sufficient to provide singulation of all coins received.

Figure 2:
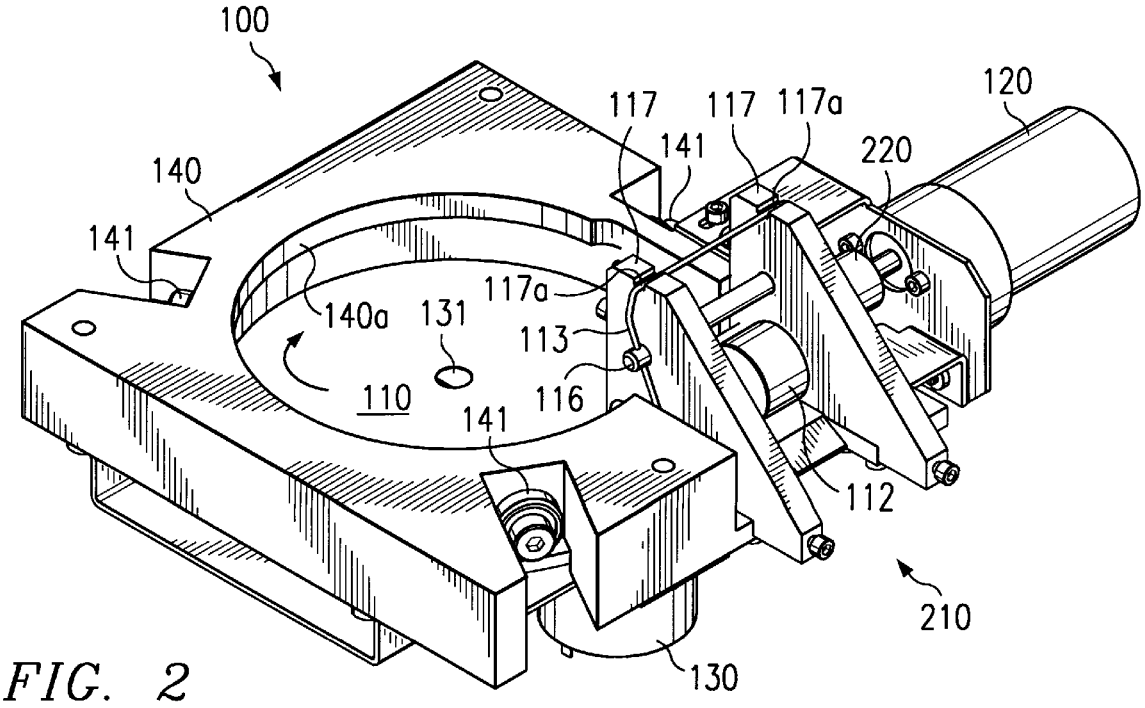
FIG. 2 shows the coin singulator of FIG. 1 in an isometric view from the front left.

Directing attention to FIG. 2, coin singulator 100 is shown in an isometric view from the front left. Here coupling 220 coupled to the shaft of motor 120 is shown. Accordingly, stripper roller 111 rotates at the same speed as that of motor 120.

Also shown in FIG. 2 is output chute 210. Output chute 210 is where coins are ejected by feed roller 112 for output from coin singulator for downstream handling. For example, a coin validator may be disposed below output chute 210 to receive the output coins in series in order to determine their value. One such validator suitable for use with the preferred embodiment of the present invention is the Multi-Coin Validator, part number 54-3000-10, available from Coin Controls, Inc., Elk Grove Village, Ill. This coin validator accepts coins at a rate of up to twelve per second and validates them in free fall. Accordingly, coin singulator 100 may be adapted to output coins at output chute 210 at a rate of twelve coins per second or less, i.e., ten coins per second to allow a reasonable margin of error, for validation by the coin validator disposed there below. It shall be appreciated that the use of such a coin validator downstream is useful as it provides rejection of the aforementioned foreign coins and other objects which may be passed by coin singulator 100. Use of such an arrangement is shown and described in the above referenced application entitled "Automatic Validating Farebox System And Method."

Figure 3:
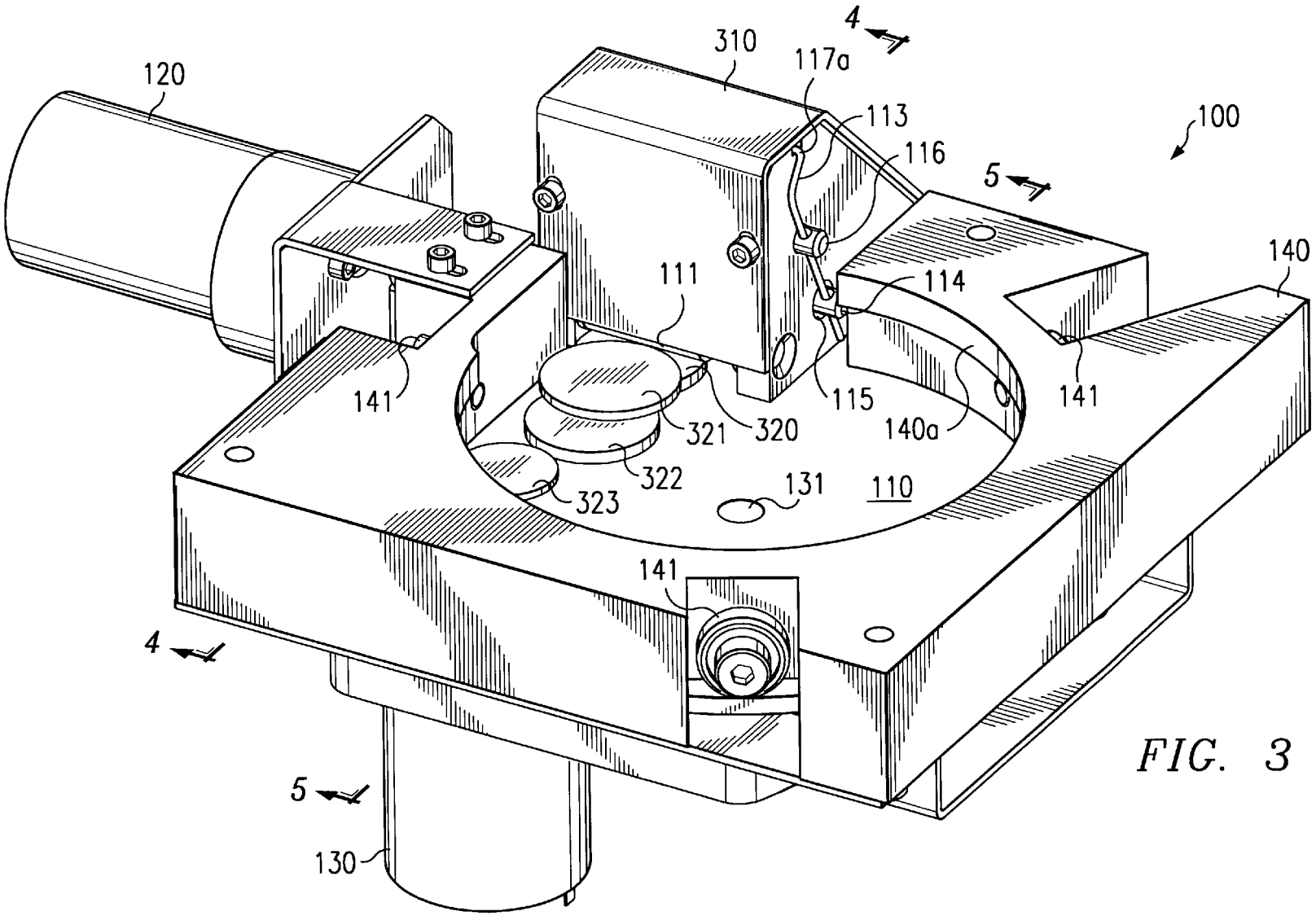
FIG. 3 shows the coin singulator of FIG. 1 in an isometric view from the back left.

Directing attention to FIG. 3, coin singulator 100 is again shown in an isometric view from the back left. Here cowl 310 is shown covering the singulation mechanism with stripper roller 111 only partially visible there below. Cowl 310 is preferably provided to prevent coins from engaging stripper roller 111 and feed roller 112 from above, such as may be caused by bouncing of the coins off of rotating disk 110 when initially received. Likewise, coins stacked sufficienty high so as to be disposed to strike stripper roller 111 above the center point are deflected by cowl 310 to prevent their being pulled into the singulating mechanism improperly. Furthermore, cowl 310 also provides deflection of coins at output chute 210 to aid in their guidance to systems downstream such as the aforementioned coin validator.

FIG. 3 also illustrates coins 320–323 in the coin receiving area of coin singulator 100. Here coins 320–323 have been moved toward the coin singulation mechanism by rotating disk 110. It should be appreciated that coins 320–323 are disposed on rotating disk 110 near frame 140 which, in operation, may be accomplished by centrifugal force.

In the illustrated example, coin 320 has begun to enter the coin singulation mechanism of coin singulator 100 and is thus disposed below stripper roller 111. However coin 321, which rests atop coins 320 and 322, if not stripped from its perch, would likely cause a multiple coin output from coin singulator 100.

Figure 4:
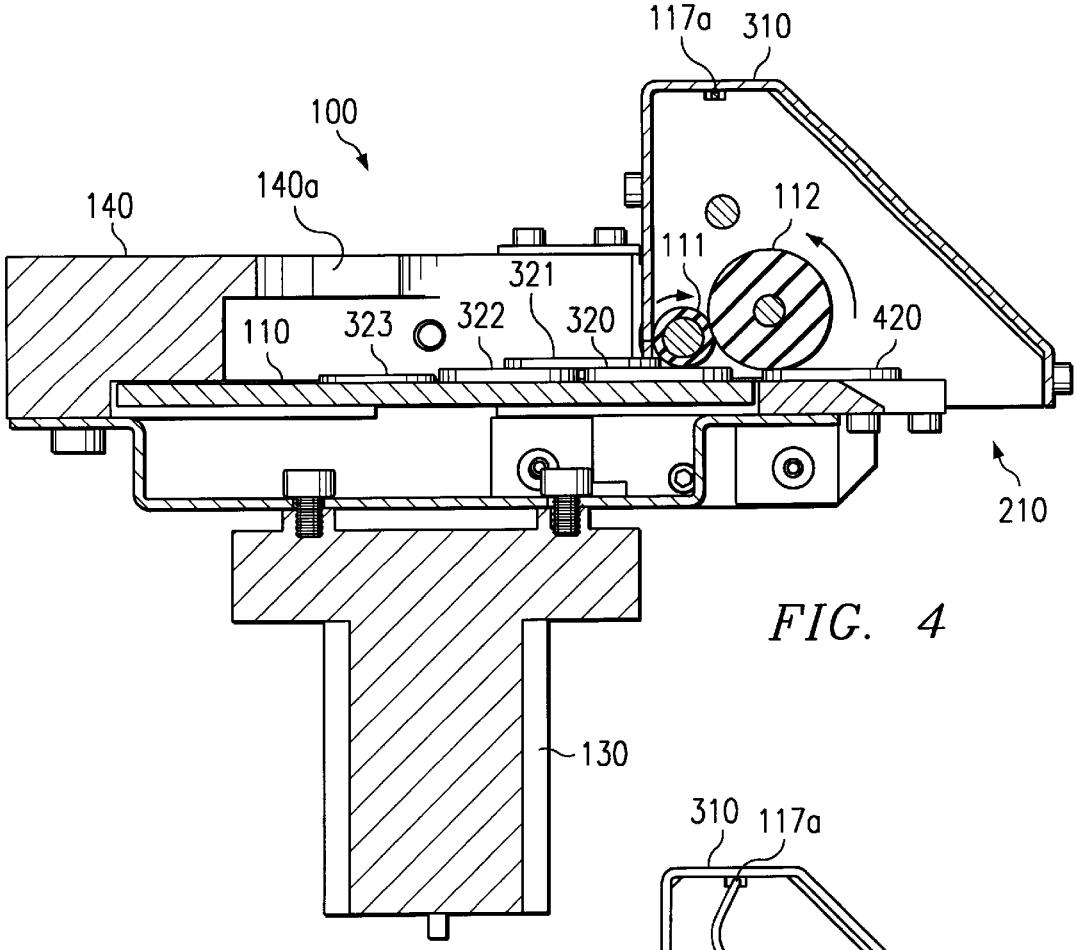
FIG. 4 shows a cross section of the coin singulator of FIG. 1.

Directing attention to FIG. 4, a cross section of coin singulator 100 is shown. Coins 320–323 are again shown in the coin receiving area of coin singulator 100. Additionally, coin 420 engaging feed roller 112 is shown just prior to output into output chute 210.

In FIG. 4 it can be seen that in operation coin 320 passes beneath stripper roller 111. However, coin 321, resting atop coins 320 and 322, will engage stripper roller 111. As the rotation of stripper roller is such that progression of a coin toward output chute 210 will be discontinued, coin 321 will be stripped from atop coin 320. Depending upon the speed at which stripper roller rotates, stripping of coin 321 from 320 may result in its ejection back into the coin receiving area such as atop coin 323 to repeat the stripping process until no coin remains there below.

In a preferred embodiment the diameter of stripper roller 111 is selected so as to present a sufficiently small area of contact with the received coins to minimize jamming of engaged received coins between stripper roller 111 and rotating disk 110. Where stripper roller 111 and feed roller 112 are engaged to transfer rotation energy therebetween, selection of the diameter of stripper roller 111 must also take into consideration the rotational speed to stripper roller 111 necessary to provide a desired amount of "kick back" of the stripped coins, as well as the rotational speed of feed roller 112 to provide a desired output of coins.

In the preferred embodiment of the present invention, the output of coins from coin singulator 100 is at a predetermined maximum rate. It shall be appreciated that, as the received coins may be of differing denominations, i.e., different sizes, the output rate of coins will vary depending upon the composition of the received coins. However, the maximum output rate of coins will be determined by the smallest accepted coin, i.e., because of their reduced size, smaller coins may be fed one after the other to result in more coins being fed in a same amount of time as larger coins fed one after the other.

Both the speed of rotation of feed roller 112 and the diameter of feed roller 112 will affect the output speed of coins. Experimentation has revealed that where United States currency is accepted, having a dime as the smallest accepted coin, a coin output of approximately ten coins per second may be accomplished utilizing a feed roller having a diameter of approximately 1.5 inches rotating at approximately 308 RPM.

Likewise, experimentation has revealed that a stripper roller of approximately half the diameter of the feed roller provides a sufficiently small area of contact with the received coins to minimize jamming of engaged received coins and a sufficiently rapid speed of rotation to provide a desired kicking back of the stripped coins. Accordingly, in a preferred embodiment of the present invention, stripper roller 111 has a radius of approximately 0.375 inches and feed roller 112 has a radius of approximately 0.75 inches.

Figure 5:
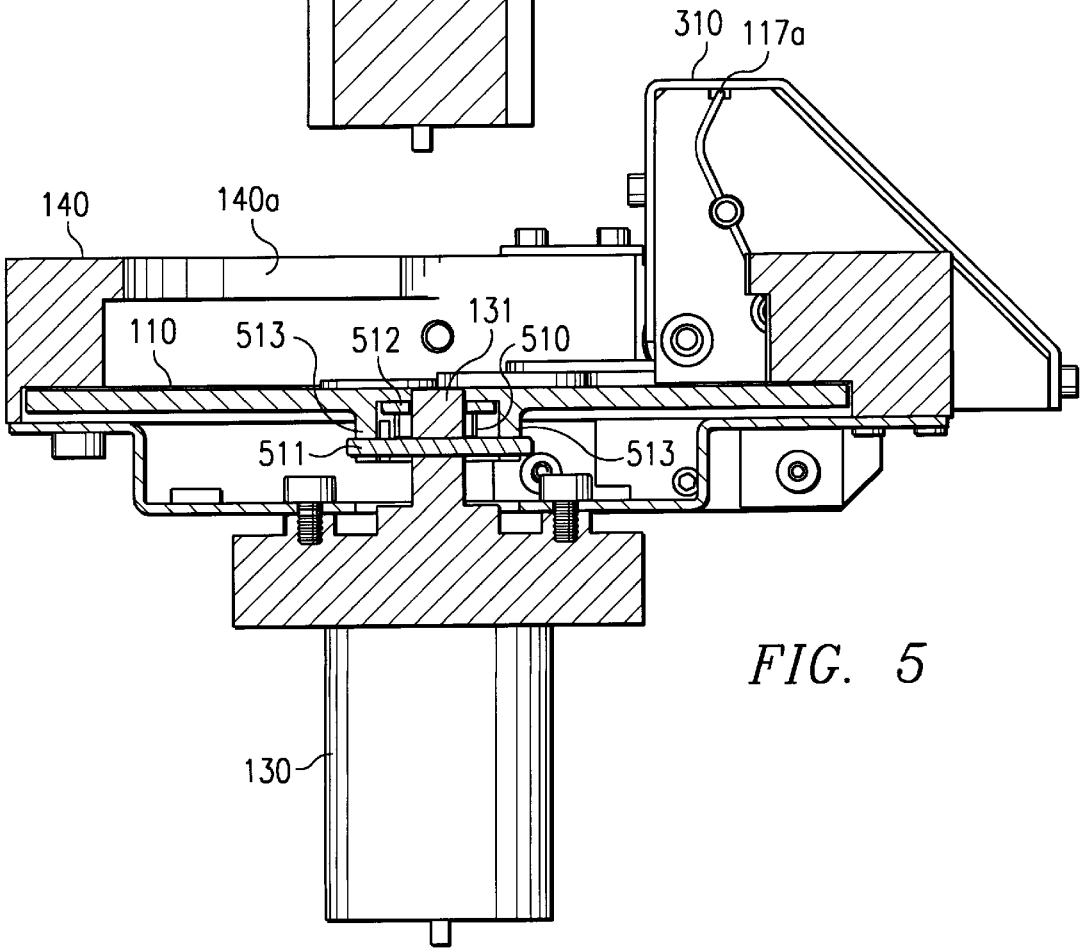
FIG. 5 shows a cross section view of coin singulator of FIG. 1.

Directing attention to FIG. 5, a cross section view of coin singulator 100 is shown where the biasing of rotating disk 110 toward frame 140 may be seen. In the preferred embodiment of FIG. 5, the bottom of rotating disk 110 includes collar 513 engaged with pin 511. Pin 511 passes through shaft 131 to transfer rotational energy from shaft 131, which is driven by motor 130, to rotating disk 110.

Disposed between pin 511 and rotating disk 110 is washer 512 and compression spring 510. Compression spring 510 operates to force rotating disk 110 away from pin 511 and, therefore, toward the bottom of frame 140 where roller bearings 141 are engaged by the top surface of rotating disk 110. Accordingly, the gap between frame 140 and rotating disk 110 may be maintained at a minimum to discourage infiltration by objects which may jam or other wise impede the rotation of rotating disk 110 by the adjustment of roller bearings 141 (see FIGS. 1, 2, and 3).

It shall be appreciated that by vertically slotting collar 513 where pin 511 is accepted, a great enough force applied in a downward direction to the surface of rotating disk 110 will result in further compression of compression spring 510 and thus increased separation between frame 140 and rotating disk 110. This may be advantageous in allowing an operator to clear jams or other wise extricate objects from the gap between frame 140 and rotating disk 110.

Although specific examples of use of the present invention have been described with respect to a fare collection system, it shall be appreciated that the coin singulator of the present invention may be utilized in any number of situations. For example, the coin singulator of the present invention may be utilized in vending machines to allow for the more rapid acceptance of coins from patrons.

Although the present invention and its advantages have been described in detail, it should be understood that various changes, substitutions and alterations can be made herein without departing from the spirit and scope of the invention as defined by the appended claims.

What is claimed is:

1. A coin handling system for providing controlled output of a plurality of different sized coins, the system comprising:

a rotating disk disposed to receive coins, wherein the received coins are encouraged to move in the direction of rotation of the rotating disk and toward a circumferential edge of the rotating disk;

a stripper roller disposed approximately at the circumferential edge of the rotating disk, wherein a longitudinal axis of the stripper roller is substantially parallel to a surface of the rotating disk, and wherein a longitudinal surface of the stripper roller is disposed a predetermined distance from the surface of the rotating disk, and wherein the stripper roller rotates in a direction opposing movement of the received coins encouraged by the rotating disk;

a feed roller disposed approximately at the circumferential edge of the rotating disk, wherein a longitudinal axis of the feed roller is substantially parallel to the surface of the rotating disk, and wherein the feed roller is movably mounted to allow a longitudinal surface of the feed roller to be disposed within a predetermined range of distances from the surface of the rotating disk, and wherein the feed roller rotates in a direction consistent with the movement of the received coins encouraged by the rotating disk, and wherein rotational propulsion of one of the stripper roller and the feed roller is transferred to the other one of the stripper roller and the feed roller to thereby provide rotational propulsion of the other one of the stripper roller and the feed roller; and a biasing spring coupled to the feed roller, wherein the biasing spring provides a first force component to encourage the feed roller to remain a smallest possible distance of the range of distances from the surface, and wherein the biasing spring provides a second force component to maintain the transfer of rotational propulsion between the stripper roller and the feed roller during movement throughout the predetermined range of distances from the surface.

2. The system of claim 1, wherein the surface of the rotating disk is a substantially uninterrupted smooth anterior surface.

3. The system of claim 1, wherein the surface is uninterrupted except for a protrusion substantially at the center of the rotating disk, wherein the protrusion discourages coins from remaining in the center of the rotating disk.

4. The system of claim 1, wherein the predetermined distance from the surface the stripper roller is disposed is less than twice the thickness of a thinnest and more than the thickness of a thickest valid coin of the plurality of different sized coins.

5. The system of claim 4, wherein the predetermined distance from the surface the stripper roller is disposed is approximately 0.096 inches.

6. The system of claim 1, wherein the predetermined range of distances from the surface the feed roller is disposed includes the thickness of a thinnest and of a thickest valid coin of the plurality of different sized coins.

7. The system of claim 6, wherein the predetermined range is approximately from 0.025 inches to 0.1 inches.

8. The system of claim 1, wherein the transfer of rotational propulsion between the stripper roller and feed roller is through surface contact of the longitudinal surface of the stripper roller and the longitudinal surface of the feed roller.

9. The system of claim 1, wherein a ratio of a diameter of the feed roller to a diameter of the stripper roller is 2:1.

10. The system of claim 9, wherein the diameter of the feed roller is selected to provide the output of the received coins below a predetermined maximum coin rate.

11. The system of claim 10, wherein the diameter of the feed roller is approximately 0.75 inches and the rotating disk rotates at approximately 150 revolutions per minute providing the predetermined maximum coin rate of approximately 10 coins per second when the received coins are United States currency.

12. The system of claim 1, further comprising:

a frame including a plurality of bearings in contact with the rotating disk, wherein the frame provides structural support to maintain the predetermined distance between the stripper roller and the rotating disk and the predetermined range of distances between the feed roller and the rotating disk.

13. The system of claim 12, further comprising a biasing spring encouraging the rotating disk to maintain contact with the plurality of bearings.

14. The system of claim 1, further comprising a coin input sensor, wherein the rotation of the rotating disk and the rotation of the stripper roller and the feed roller is controlled at least in part by the coin input sensor detecting coin input.

15. A coin system for accepting a plurality of coins and outputting each one of the plurality of coins at a predetermined maximum rate, wherein ones of the plurality of coins may be of differing sizes including differing thickness, the system comprising:

means for containing the accepted plurality of coins for subsequent output at a predetermined maximum rate;

means for propelling the accepted plurality of coins within the containing means;

means for stripping a first stacked one of the accepted plurality of coins from a second stacked one of the accepted plurality of coins thereby providing a first stripped coin and a second stripped coin, wherein the first stripped coin remains within the containing means;

means coupled to the stripping means for removing the second stripped coin from the containing means, wherein the second stripped coin is output from the containing means with a predetermined minimum time between a previously output coin and a subsequently output coin to remain within the predetermined maximum output rate, and means for dynamically adjusting the removing means for interaction with the second stripped coin as a function of a thickness of the second stripped coin.

16. The system of claim 15, wherein the stripping means comprises a first rotating surface and the removing means comprises a second rotating surface, wherein the first surface rotates in a direction opposite of that of the second rotating surface.

17. The system of claim 16, wherein the first rotating surface rotates at approximately twice the rate of the second rotating surface.

18. The system of claim 15, further comprising:

means for detecting the presence of the accepted plurality of coins, wherein the propelling means, the stripping means and the removing means are activated upon detection of the presence of the accepted plurality of coins by the detecting means.

19. A method for accepting a plurality of coins substantially simultaneously and providing controlled output of the plurality of coins, wherein ones of the plurality of coins may be of differing sizes including differing thickness, the method comprising the steps of:

containing within a defined area the accepted plurality of coins for subsequent controlled output from the defined area;

propelling the accepted plurality of coins within the defined area, wherein the step of propelling the accepted plurality of coins relies only upon centrifugal force and surface friction between ones of the accepted plurality of coins and a propeller surface;

stripping a first stacked one of the accepted plurality of coins from a second stacked one of the accepted plurality of coins thereby providing a first stripped coin and a second stripped coin, wherein the first stripped coin remains within the defined area; and removing the first stripped coin and the second stripped coin from the defined area, wherein the stripped coins are output from the defined area one at the time, wherein the stripping step comprises the step of rotating a first surface and the removing step comprises the step of rotating a second surface, wherein rotation of the first surface is in a direction opposite of that of rotation of the second surface, and wherein rotation of the first surface is approximately twice the rate of rotation of the second surface.

20. The method of claim 19, wherein the output of the coins from the defined area accomplished by the removing step provides output of the coins at a predetermined rate with respect to a previously output coin and a subsequently output coin to provide a predetermined maximum output rate.

21. The method of claim 19, wherein the removing step comprises the step of:

automatically adjusting a position of the second surface for interaction with the second stripped coin as a function of a thickness of the second stripped coin.

22. A coin system for accepting a coin and providing controlled output of the coin, wherein the coin may be any size of a plurality of different sizes, the system comprising:

means for containing the accepted coin for subsequent manipulation and subsequent output from the containing means;

means for manipulating the accepted coin within the containing means;

a first rotating surface for prohibiting output from the containing means of the accepted coin if a top surface of the coin is disposed more than a predetermined distance from a surface of the containing means; and a second rotating surface coupled to the first rotating surface for removing the accepted coin from the containing means to thereby provide controlled output of the accepted coin from the containing means if the accepted coin is not prohibited from output from the containing means by the first rotating surface, wherein the first surface rotates in a direction opposite of that of the second rotating surface at approximately twice the rate of the second rotating surface.

23. The system of claim 22, further comprising:

means for dynamically adjusting the second rotating surface for interaction with the accepted coin as a function of a thickness of the accepted coin.

24. The system of claim 23, wherein said dynamically adjusting means comprises a biasing spring providing a force component to maintain surface contact between the first rotating surface and the second rotating surface during dynamic adjustment of the second rotating surface.

25. The system of claim 23, wherein said dynamically adjusting means comprises a biasing spring providing a force component to encourage the second rotating surface to remain a smallest possible distance from a surface of the manipulating means for interaction with the accepted coin.

26. A method for accepting a coin and subsequently providing controlled output of the coin, wherein the coin may be any size of a plurality of different sizes, the method comprising the steps of:

containing within a defined area the accepted coin for subsequent controlled output from the defined area;

manipulating the accepted coin within the defined area, wherein the step of manipulating the accepted coin relies only upon centrifugal forces and surface friction forces;

prohibiting output from the contained area of the accepted coin if a top surface of the coin is disposed more than a predetermined distance from a surface of the defined area, wherein the prohibiting step comprises the step of rotating a first surface and; and removing the accepted coin from the defined area to thereby provide controlled output of the accepted coin from the containing means if the accepted coin is not prohibited from output from the defined area by the prohibiting step, wherein the removing step comprises the steps of rotating a second surface and dynamically adjusting the second surface for interaction with the accepted coin as a function of a thickness of the accepted coin.

27. The method of claim 26, wherein the output of the accepted coin from the defined area accomplished by the removing step provides output of the accepted coin at a predetermined rate with respect to a previously output coin and a subsequently output coin to provide a predetermined maximum output rate.

28. The method of claim 26, wherein rotation of the first surface is in a direction opposite of that of rotation of the second surface.

29. The system of claim 26, wherein the step of containing the accepted coin comprises the step of:

discouraging the accepted coin from standing on end, wherein said discouraging step relies at least in part on a ledge adapted to discourage any of a plurality of different sized coins from standing on end.

30. A coin singulator for providing singulation of multiple sized coins received substantially simultaneously by the singulator, the singulator comprising:

a rotating surface disposed to receive a plurality of coins substantially simultaneously, the rotating surface having a friction coefficient sufficiently great to provide movement of the received coins in the direction of rotation of the rotating surface, wherein the friction coefficient is sufficiently small to allow the received coins to travel radially outward across the rotating surface;

a frame disposed above the rotating surface, the frame providing an incarcerating wall surface which in combination with the rotating surface defines a coin reception area, wherein the incarcerating wall limits the radially outward travel of the received coins across the rotating surface;

a first cylinder disposed to engage coins near the incarcerating wall, wherein a longitudinal surface of the first cylinder is substantially parallel to the rotating surface and is disposed a predetermined distance from the rotating surface, and wherein the first cylinder rotates in a direction opposing the movement of the received coins provided by the rotating surface; and a second cylinder disposed to engage coins near the incarcerating wall, wherein a longitudinal surface of the second cylinder is substantially parallel to the rotating surface and is movably coupled to the frame to allow the longitudinal surface of the second cylinder to travel a predetermined range of distances from the rotating surface, and wherein the second cylinder rotates in a direction opposite that of the first cylinder, and wherein the radius of the second cylinder is selected to provide a predetermined maximum feed rate of the received coins.

31. The singulator of claim 30, wherein the rotating surface is a substantially uninterrupted flat surface.

32. The singulator of claim 31, wherein the rotating surface includes an irregularity in the flat surface at the rotation axis to prevent the received coins from remaining at the rotation axis.

33. The singulator of claim 31, wherein the incarcerating wall surface is a substantially smooth surface substantially interrupted only at the point where the first cylinder engages coins.

34. The singulator of claim 30, wherein one of the first cylinder and the second cylinder drives the rotation of the other one of the first cylinder and the second cylinder.

35. The singulator of claim 34, further comprising:

biasing providing a first force component to encourage the second cylinder to remain a smallest possible distance of the range of distances from the rotating surface and a second force component to maintain the rotational drive between the first cylinder and the second cylinder.

36. The singulator of claim 34, wherein the radius of the second cylinder is approximately twice the radius of the first cylinder.

37. The singulator of claim 30, wherein the predetermined maximum feed rate of the received coins is approximately 10 coins per second.

38. The singulator of claim 30, wherein the radius of the second cylinder is approximately 0.75 inches.

39. The singulator of claim 30, wherein the radius of the first cylinder is selected to present a sufficiently small area of contact with the received coins engaged by the first cylinder to minimize jamming of engaged received coins between the surface of the first cylinder and the rotating surface.

40. The singulator of claim 39, wherein the radius of the first cylinder is approximately 0.375 inches.

41. A coin singulator for providing singulation of multiple sized coins received substantially simultaneously by the singulator, wherein the coin singulator provides substantially unrestricted access to the received coins, the singulator comprising:

a rotating surface disposed to receive a plurality of coins substantially simultaneously, the rotating surface providing a friction sufficiently great to provide movement of the received coins in the direction of rotation of the rotating surface, wherein the friction is sufficiently small to allow the received coins to travel radially outward across the rotating surface, and wherein the movement of the received coins in the direction of rotation of the rotating surface is provided solely by the friction between the rotating surface and the received coins;

a frame disposed above the rotating surface, the frame providing an incarcerating wall surface in combination with the rotating surface defining a coin reception area, wherein the incarcerating wall limits the radially outward travel of the received coins across the rotating surface, and wherein the incarcerating wall provides a substantially smooth surface where the received coins come into contact with the incarcerating wall, and wherein the frame includes bearings disposed thereon rotatably engaging the rotating surface;

a first cylinder having a first diameter disposed to engage coins near the incarcerating wall, wherein a longitudinal surface of the first cylinder is substantially parallel to the rotating surface and is disposed a predetermined distance from the rotating surface, and wherein the first cylinder rotates in a direction opposing the movement of the received coins provided by the rotating surface;

a second cylinder having a second diameter disposed to engage coins near the incarcerating wall, wherein a longitudinal surface of the second cylinder is substantially parallel to the rotating surface and is movably mounted to allow the longitudinal surface of the second cylinder to travel a predetermined range of distances from the rotating surface, and wherein the longitudinal surface of the second cylinder is in mechanical communication with the longitudinal surface of the first cylinder thereby causing the second cylinder to rotate in a direction opposite that of the first cylinder; and a biasing spring assembly coupled to the second cylinder and providing a first force component to maintain the mechanical communication of the longitudinal surface of the first cylinder and the longitudinal surface of the second cylinder, wherein the biasing spring assembly also provides a second force component encouraging the second cylinder to maintain the longitudinal surface of the second cylinder a minimum possible distance from the rotating surface.

42. The singulator of claim 41, wherein the biasing spring assembly comprises a single spring providing both force components.

43. The singulator of claim 41, wherein the radius of the second cylinder is approximately twice the radius of the first cylinder.

44. The singulator of claim 41, wherein the predetermined maximum feed rate of the received coins is approximately 10 coins per second.

45. The singulator of claim 41, wherein the diameter of the second cylinder is approximately 1.5 inches.

46. The singulator of claim 41, wherein the rotating surface rotates at approximately 150 revolutions per minute.

47. A coin singulator for providing singulation of multiple sized coins received substantially simultaneously by the singulator, the singulator comprising:

a rotating surface disposed to receive a plurality of coins substantially simultaneously, the rotating surface having a friction coefficient sufficiently great to provide movement of the received coins in the direction of rotation of the rotating surface, wherein the friction coefficient is sufficiently small to allow the received coins to travel radially outward across the rotating surface;

a frame disposed above the rotating surface, the frame providing an incarcerating wall surface which in combination with the rotating surface defines a coin reception area, wherein the incarcerating wall limits the radially outward travel of the received coins across the rotating surface;

a first cylinder disposed to engage coins near the incarcerating wall, wherein a longitudinal surface of the first cylinder is substantially parallel to the rotating surface and is disposed a predetermined distance from the rotating surface, and wherein the first cylinder rotates in a direction opposing the movement of the received coins provided by the rotating surface;

a second cylinder disposed to engage coins near the incarcerating wall, wherein a longitudinal surface of the second cylinder is substantially parallel to the rotating surface and is movably coupled to the frame to allow the longitudinal surface of the second cylinder to travel a predetermined range of distances from the rotating surface, and wherein the second cylinder rotates in a direction opposite that of the first cylinder, wherein one of the first cylinder and the second cylinder drives the rotation of the other one of the first cylinder and the second cylinder; and biasing providing a first force component to encourage the second cylinder to remain a smallest possible distance of the range of distances from the rotating surface and a second force component to maintain the rotational drive between the first cylinder and the second cylinder.

48. A coin singulator for providing singulation of multiple sized coins received substantially simultaneously by the singulator, the singulator comprising:

a rotating surface disposed to receive a plurality of coins substantially simultaneously, the rotating surface having a friction coefficient sufficiently great to provide movement of the received coins in the direction of rotation of the rotating surface, wherein the friction coefficient is sufficiently small to allow the received coins to travel radially outward across the rotating surface;

a frame disposed above the rotating surface, the frame providing an incarcerating wall surface which in combination with the rotating surface defines a coin reception area, wherein the incarcerating wall limits the radially outward travel of the received coins across the rotating surface;

a first cylinder disposed to engage coins near the incarcerating wall, wherein a longitudinal surface of the first cylinder is substantially parallel to the rotating surface and is disposed a predetermined distance from the rotating surface, and wherein the first cylinder rotates in a direction opposing the movement of the received coins provided by the rotating surface, and wherein the radius of the first cylinder is selected to present a sufficiently small area of contact with the received coins engaged by the first cylinder to minimize jamming of engaged received coins between the surface of the first cylinder and the rotating surface; and a second cylinder disposed to engage coins near the incarcerating wall, wherein a longitudinal surface of the second cylinder is substantially parallel to the rotating surface and is movably coupled to the frame to allow the longitudinal surface of the second cylinder to travel a predetermined range of distances from the rotating surface, and wherein the second cylinder rotates in a direction opposite that of the first cylinder.

49. The singulator of claim 48, wherein the radius of the first cylinder is approximately 0.375 inches.

* * * * *